US005363631A

United States Patent [19]

Garrison

[11] Patent Number: 5,363,631

[45] Date of Patent: Nov. 15, 1994

[54] SHOCK-REDUCING SADDLE PAD

[76] Inventor: Tim Garrison, 3806 E. Hancock, Muskogee, Okla. 74403

[21] Appl. No.: 168,775

[22] Filed: Dec. 16, 1993

[51] Int. Cl.[5] ..... B68C 1/12

[52] U.S. Cl. ..... 54/66

[58] Field of Search ..... 54/44.1, 65, 66; 5/450

[56] References Cited

U.S. PATENT DOCUMENTS

| | | | |
|---|---|---|---|
| 3,663,973 | 5/1972 | Spence | 5/450 |
| 4,588,229 | 5/1986 | Jay | 5/450 |
| 4,974,397 | 12/1990 | Ricken | 54/66 |
| 5,119,618 | 6/1992 | Streck | 54/66 |
| 5,175,889 | 1/1993 | Infusino | 2/413 |
| 5,175,986 | 1/1993 | Farley | 54/44.1 |
| 5,299,412 | 4/1994 | Cudney et al. | 54/66 |

*Primary Examiner*—Robert P. Swiatek
*Attorney, Agent, or Firm*—Head & Johnson

[57] ABSTRACT

An improved shock-reducing saddle pad comprising a layer of polyurethane foam having an upper side to which is attached a T-shaped pocket. Inside the T-shaped pocket there is a plastic-encased impact dispersing gel mold. A cover material is placed over the entire upper side of the layer of polyurethane foam, including the T-shaped pocket filled with the gel mold. To the under side of the layer of polyurethane foam there is attached a layer of a lightweight, elastomeric rubber which, while also absorbing downwardly directed impact forces, conforms to the contour of the horse's back, preventing slippage of the saddle pad and saddle, though not absorbing sweat.

8 Claims, 2 Drawing Sheets

SHOCK-REDUCING SADDLE PAD

BACKGROUND OF THE INVENTION

Commonly, saddle pads are placed between the horse and saddle to protect the horse from irritation caused by the weight of the saddle and rider and to help prevent slippage of the saddle from its proper position over the withers and back of the horse. Historically, blankets and other woven products were used between the horse and saddle. More recently, cushioning substances such as polyurethane foams have been employed to create a pad between the horse and saddle.

These saddle blankets and foam saddle pads, while providing some protection to the horse, do not, however, give much relief from the constant rubbing and pounding the saddle and rider inflict on horses generally, and especially horses involved in rigorous training regimens. Horses subjected to daily training are prone to develop soreness over the withers, shoulders and back. This soreness is attributable to the tendency of the saddle to dig into the horse's withers and back, abrasions caused by the rubbing of the saddle, bruises administered by the bouncing weight of the saddle and rider, and/or structural defects in bones, ligaments and tendons produced by sharp impact forces generated by the saddle and rider.

Additionally, woven blankets and most saddle pads are absorptive in nature, soaking up the sweat of the horse. This diminishes the horse's ability to cool itself through the evaporation of sweat. Further, saddle blankets and pads have a tendency to splay out from the horse at their periphery rather than conforming to the contour of the horse, decreasing the surface area contacted by the blankets or pads. Still further, the blankets and pads tend to become compressed after periods of use. The more compressed the blankets and pads become, the less effective they are in preventing injury to the animal.

SUMMARY OF THE INVENTION

It is therefore an object of this invention to overcome the limitations of the prior art by providing an improved shock-reducing saddle pad which significantly lessens the impact forces imparted to the horse's withers, shoulders, spine and back by counterbalancing and dispersing downwardly directed forces instead of passing on such forces to the horse.

It is another object of this invention to provide a shock-reducing saddle pad that utilizes an impact dispersing gel mold to absorb the impact forces created by the weight of the saddle and rider, the gel mold being relatively quick and easy to manufacture.

It is a further object of this invention to provide a shock-reducing saddle pad which incorporates a layer of a lightweight, closed-cell elastomeric rubber that aids in preventing slippage and which will, therefore, protect the horse from skin abrasions caused by constant rubbing.

It is another object of this invention to provide a saddle pad which fully conforms to the contour of the horse's back, increasing the surface area contacted by the pad, but which does not absorb sweat.

It is a still further object of this invention to provide a saddle pad which, when loaded and unloaded, recovers substantially all of its original thickness. In other words, the saddle pad does not become significantly compressed.

These and other objects are achieved by providing an improved shock-reducing saddle pad comprising a layer of polyurethane foam having an upper side to which is attached a T-shaped pocket. Inside the T-shaped pocket there is a plastic-encased impact dispersing gel mold. A cover material is placed over the entire upper side of the layer of polyurethane foam, including the T-shaped pocket filled with the gel mold. To the under side of the layer of polyurethane foam there is attached a layer of a lightweight, closed-cell elastomeric rubber which, while also absorbing downwardly directed impact forces, conforms to the contour of the horse's back, preventing slippage of the saddle pad and saddle, though not absorbing sweat.

A better understanding of the invention, and the objects thereof, will be obtained from the following description, taken in conjunction with the attached drawings.

DETAILED DESCRIPTION OF THE PREFERRED

Figure 1:
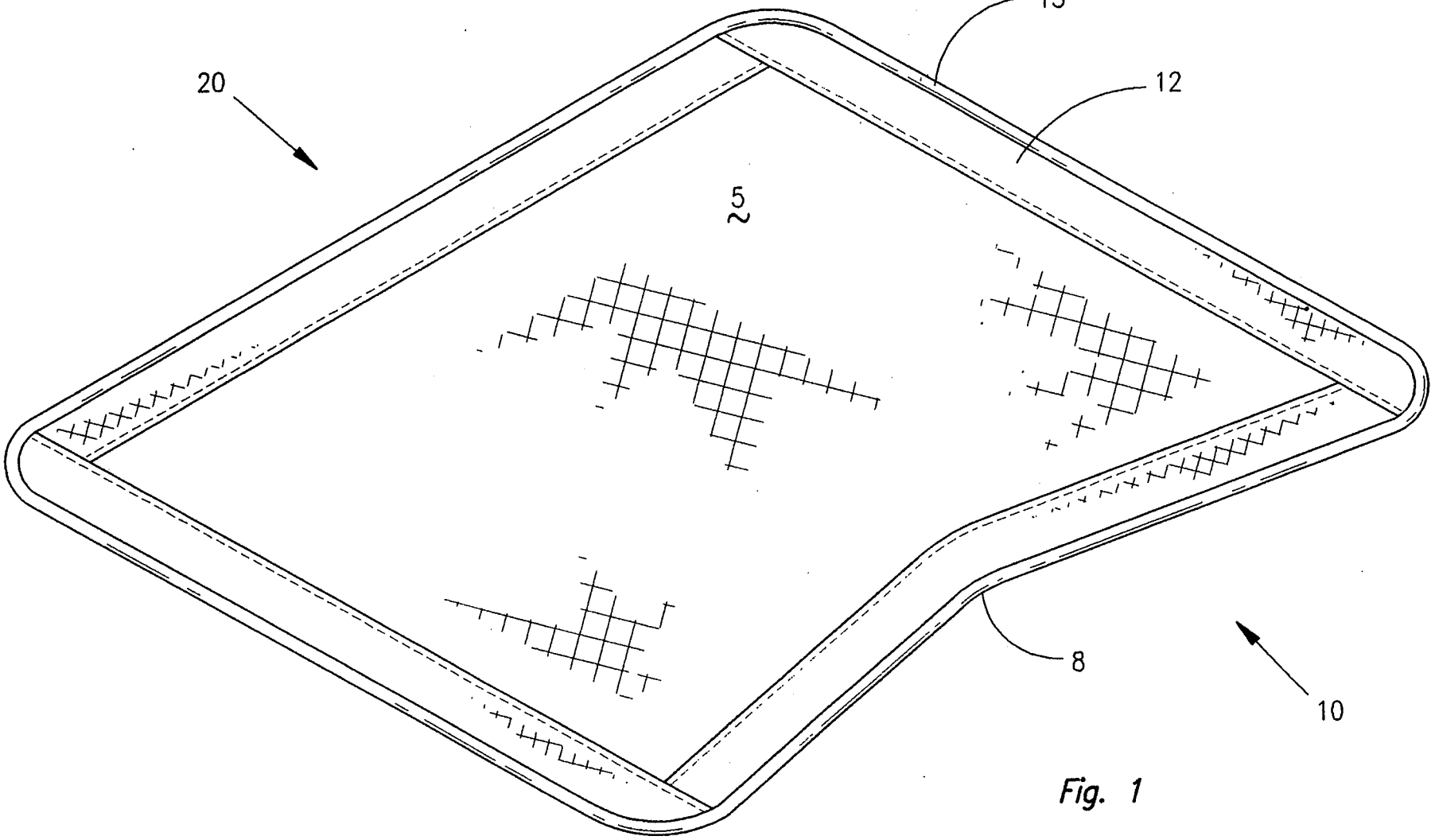
FIG. 1 is a three-quarter perspective view of the top side of the preferred embodiment of the invention from above and to the left side of the invention.

Referring to FIG. 1, the front end of the saddle pad of this invention is indicated generally by the numeral 10, while the posterior end is generally indicated by the numeral 20. A cover material 5 is exposed on the top side of the saddle pad. The front end 10 of the saddle pad is slightly V-shaped so as to create a withers' notch 8 which aids in stabilizing the saddle pad while in place on the horse. Around the periphery of the top side of the saddle pad is sewn a border 12. Surrounding border 12 is a double seam binding 13.

The cover material 5 and the border 12 of the saddle pad may be made of any tough, non-elastic material. In the preferred embodiment of this invention, marine vinyl or leather is utilized.

Figure 2:
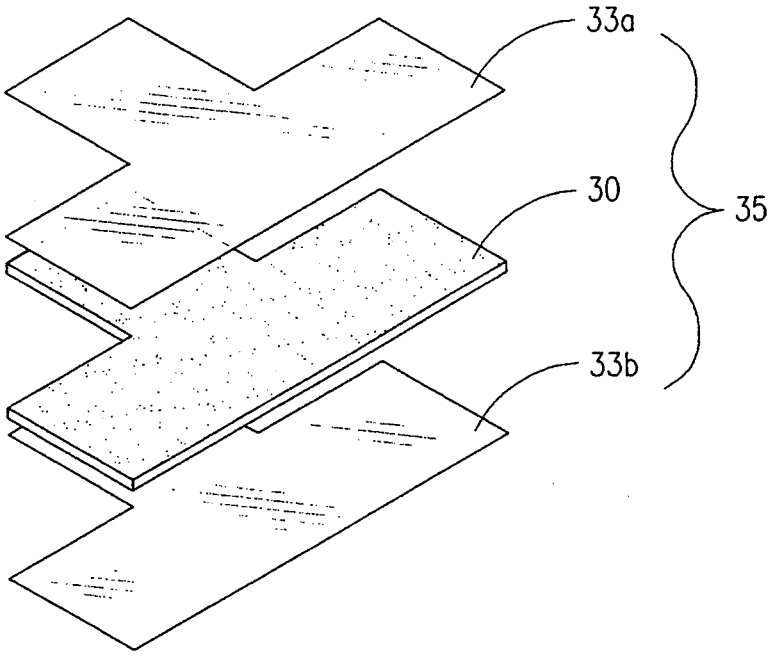
FIG. 2 is an exploded view of the plastic-encased T-shaped gel mold of the invention.

Referring now to FIG. 2, the shock-reducing, plastic-encased gel mold of this invention is generally indicated by the numeral 35. In the preferred embodiment of this invention, gel mold 30 comprises a mixture of polyvinyl chloride, well-known plasticizers (softeners), and urethane. Gel mold 30 of the invention is formed by (1) mixing polyvinyl chloride with plasticizers to obtain a first mixture, having the approximate color and viscosity of milk, (2) heating the first mixture to approximately 200° F., (3) adding to the first mixture approximately 12.5% by volume of urethane to obtain a second mixture, and (4) heating the second mixture to approximately 350° F. to obtain a final gel composition. The ratio in the first mixture of polyvinyl chloride to plasticizers is widely variable, with gel mold 30 correspondingly increasing or decreasing in softness depending upon the quality and quantity of plasticizers utilized. Generally, however, a first mixture of around 17% polyvinyl chloride to 83% plasticizers is recommended. After heating, the final gel composition is poured into molding trays, where the composition cools in approximately 20 minutes to form the gel mold 30 of the preferred embodiment of this invention.

Gel mold 30 is encased by two sheets of flexible plastic wrapping 33*a* and 33*b*. The periphery of the two sheets of plastic wrapping are heat sealed around gel mold 30 to obtain plastic-encased gel mold 35.

Figure 3:
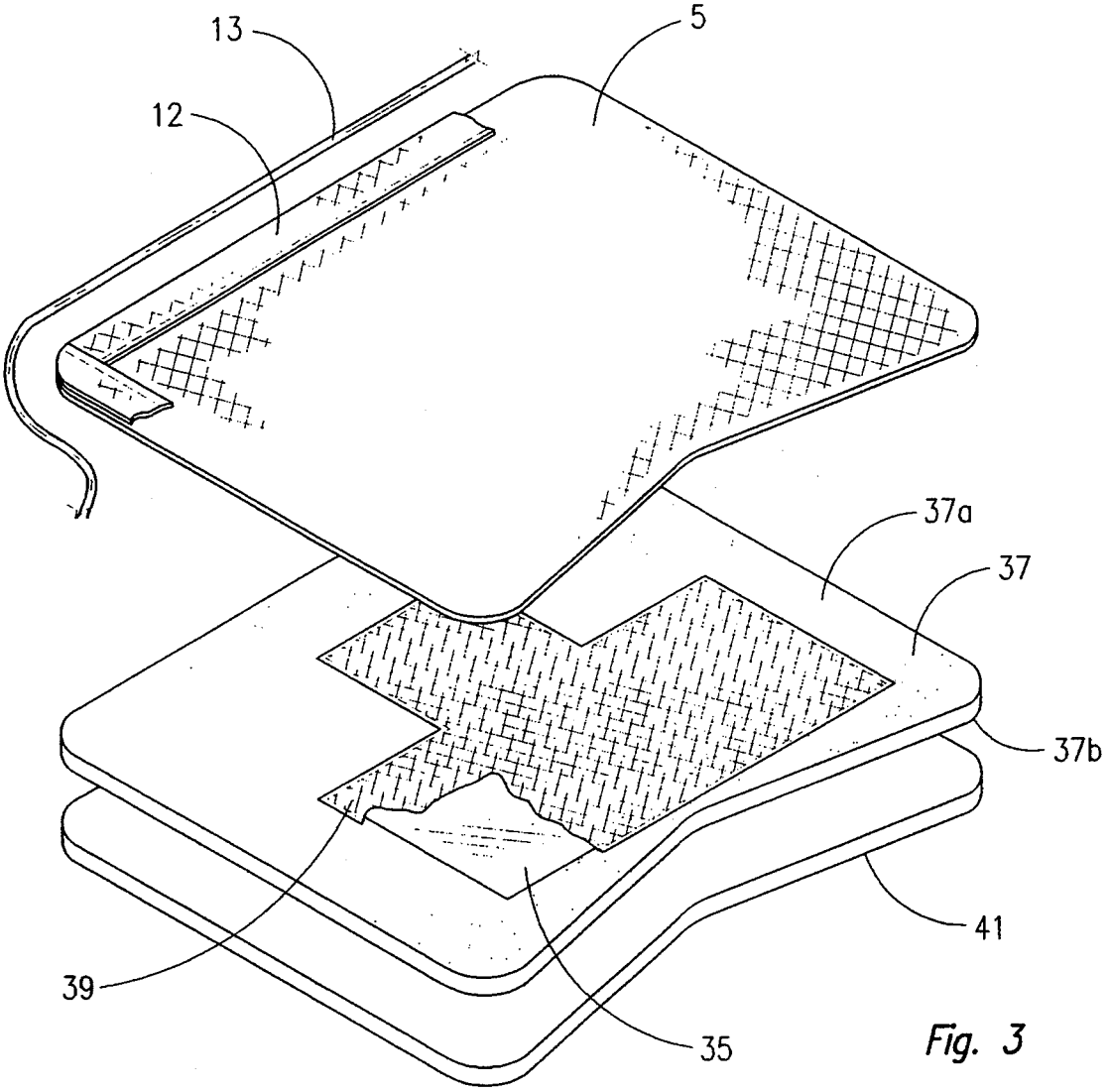
FIG. 3 is an exploded view of the invention as a whole.

Referring now to FIG. 3, the preferred embodiment of this invention comprises a layer of polyurethane foam 37 having an upper surface 37*a* and a lower surface 37*b*. The plastic-encased gel mold 35 is disposed on the upper surface 37*a* of the layer of polyurethane foam 37. A dust cover material 39, slightly larger in size than plastic-encased gel mold 35, is sewn about plastic-encased gel mold 35 directly to upper surface 37*a* of the layer of polyurethane foam 37. The attachment of the dust cover material 39 to upper surface 37*a* of the layer of polyurethane foam 37 creates a pocket which functions to hold in place plastic-encased gel mold 35.

To lower surface 37*b* of the layer of polyurethane foam 37 there is attached a cheesecloth backing (not shown). To the cheesecloth backing of the layer of polyurethane foam 37 there is adhesively attached a layer of a closed-cell elastomeric rubber 41, such as NBR/PVC elastomeric foam, trade name Insol-Sheet, manufactured by Halstead Industries. A cover material 5 of marine vinyl or leather is placed over upper surface 37*a* of the layer of polyurethane foam 37, including the T-shaped dust cover material 39. The periphery of cover material 5, layer of polyurethane foam 37 and layer of elastomeric rubber 41 are bound by the use of border 12 and a double sewn binding 13.

In the preferred embodiment, the layer of polyurethane foam 37 is approximately ½ inch to ¾ inch in thickness. Gel mold 30 is approximately ⅛ inch to ¼ inch in thickness, and the layer of elastomeric rubber 41 is approximately 3/8 inch in thickness.

The saddle pad of the present invention can be economically manufactured in a variety of shapes and sizes to accommodate varying sizes of horses and styles of saddles. But regardless of the size or style of the saddle pad, it functions to significantly reduce the risk of soreness or injury in horses, whether the horse is a pleasure horse ridden intermittently or whether the horse is involved in a demanding training program.

Gel mold 30 works to substantially reduce the impact forces transmitted to the horse by the bouncing weight of the rider and operates to prevent significant compression of the saddle pad over time. First, the resilient characteristic of gel mold 30 functions to supply a reactant upwardly directed force in response to the downwardly directed forces associated with the weight of the saddle and rider. Secondly, the composition of gel mold 30 allows for the wave-like dispersal of the downwardly directed impact forces throughout gel mold 30.

In a test relating to impact attenuation, or energy absorption, (similar to one widely used in the automotive industry), a headform dummy was dropped from various heights upon the saddle pad of this invention supported on a recoil measuring device. The average amount of recoil was measured and recorded as an "Average "G" Force". A zero measurement would mean that the impact was completely attenuated, such as would be the case if the headform dummy was dropped, for example, into jello. A measurement under 200 is considered good, under 100 is considered excellent:

| Drop Height | Average "G" Force |
|---|---|
| 1 ft. | 65 |
| 2 ft. | 172 |
| 3 ft. | 262 |

A compression set experiment was also conducted on the saddle pad of this invention wherein the sample pad was loaded and unloaded. When allowed to recover, the amount that the sample did not recover was measured. This was reported as a percentage, the lower percentage indicating more recovery. A comparison was made between the saddle pad of this invention (including gel mold 30) and a similarly constructed pad which did not contain gel mold 30. The results were as follows:

| Sample | Percent Non-Recovery |
|---|---|
| T-Pad | 5.48 av. |
| T-Pad (no gel) | 7.76 av. |

Obviously, gel mold 30 functions to increase the resiliency of the saddle pad.

The layer of elastomeric rubber 41, besides itself absorbing shocks and dispersing vibrations, also conforms to the contour of the horse's back to work like a channel, holding itself and the saddle in place, preventing the sliding of the pad and saddle back and forth over the withers, back and shoulders of the animal or side to side. Further, the rubber material is nonabsorbent, allowing the sweat of the animal to facilitate cooling.

The plastic-encased gel mold 35 when used in connection with the layer of polyurethane foam 37, layer of elastomeric rubber 41 and layer of cover material 5 combines to provide an economical, easily manufactured shock-reducing saddle pad for use by week-end horsemen and professionals alike. The saddle pad of this invention overcomes the limitations of the prior art and significantly reduces the risk of injury to horses.

The claims and the specification describe the invention presented, and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A saddle pad, comprising:

(a) a layer of polyurethane foam having an upper surface and a lower surface, said upper surface having a pocket;

(b) an impact dispersing gel mold disposed inside said pocket;

(c) a layer of elastomeric rubber, said rubber being attached to said lower surface of said layer of polyurethane foam; and (d) a layer of cover material, said cover material being attached to said upper surface of said layer of polyurethane foam.

2. A saddle pad according to claim 1, wherein said impact dispersing gel mold comprises a mixture of polyvinyl chloride, plasticizers and urethane.

3. A saddle pad according to claim 1, wherein said impact dispersing gel mold is sealed within a flexible plastic wrapping.

4. A saddle pad according to claim 1, wherein said impact dispersing gel mold is approximately $\frac{1}{8}$ inch to $\frac{1}{4}$ inch in thickness.

5. A saddle pad according to claim 1, wherein said layer of polyurethane foam is approximately $\frac{1}{2}$ inch to $\frac{3}{4}$ inch in thickness.

6. A saddle pad according to claim 1, wherein said layer of rubber material is approximately 3/8 inch in thickness.

7. A saddle pad according to claim 1, where said pocket is T-shaped.

8. A saddle pad, comprising:

(a) a layer of polyurethane foam approximately $\frac{1}{2}$ inch to $\frac{3}{4}$ inch in thickness having an upper surface and a lower surface, said upper surface having a T-shaped dust cover material attached thereto to obtain a T-shaped pocket and said lower surface having a cheesecloth backing;

(b) a plastic-encased T-shaped gel mold having an approximate thickness of $\frac{1}{8}$ to $\frac{1}{4}$ inch disposed within said T-shaped pocket, said T-shaped gel mold comprising a mixture of polyvinyl chloride, plasticizers and urethane;

(c) a layer of elastomeric rubber of approximately 3/8 inch in thickness, said rubber being attached to said lower surface of said layer of polyurethane foam; and (d) a layer of cover material, said cover material being attached to said upper surface of said layer of polyurethane foam, said cover material selected from a group comprising marine vinyl and leather.

* * * * *